US008782823B2

(12) United States Patent
Gonzalez

(10) Patent No.: US 8,782,823 B2
(45) Date of Patent: Jul. 22, 2014

(54) SYSTEM FOR STOWING A ROBOT IN A SWIMMING POOL

(75) Inventor: Serge Gonzalez, Porto Vecchio (FR)

(73) Assignee: Gonzalez, Porto Vecchio (FR)

( * ) Notice: Subject to any disclaimer, the term of this patent is extended or adjusted under 35 U.S.C. 154(b) by 569 days.

(21) Appl. No.: 12/731,532

(22) Filed: Mar. 25, 2010

(65) Prior Publication Data

US 2010/0242165 A1 Sep. 30, 2010

(30) Foreign Application Priority Data

Mar. 30, 2009 (FR) ..... 09 51974

(51) Int. Cl.
*E04H 4/16* (2006.01)

(52) U.S. Cl.
USPC ..... 4/490; 134/168 R

(58) Field of Classification Search
CPC ..... E04H 4/16; E04H 4/1636; E04H 4/1645; E04H 4/1654; E04H 4/1672; E04H 4/1663; E04H 4/1681
USPC ..... 4/490, 507–509; 15/1.7; 210/169, 210/416.1–416.2; 134/167 R, 168 R
See application file for complete search history.

(56) References Cited

U.S. PATENT DOCUMENTS

| | | | | |
|---|---|---|---|---|
| 2,979,733 | A * | 4/1961 | Saint Clair et al. | 4/490 |
| 3,530,511 | A * | 9/1970 | Berg et al. | 4/490 |
| 4,592,378 | A * | 6/1986 | Frentzel | 4/490 |
| 6,652,742 | B2 * | 11/2003 | Henkin et al. | 4/490 |
| 6,922,855 | B1 | 8/2005 | Swalley et al. | |
| 6,971,124 | B2 * | 12/2005 | Pansini | 4/490 |

OTHER PUBLICATIONS

Preliminary Patentability Report of the European Patent Office, regarding FR 0 951 974, dated Nov. 24, 2009.

* cited by examiner

*Primary Examiner* — Huyen Le
*Assistant Examiner* — Erin Deery
(74) *Attorney, Agent, or Firm* — Workman Nydegger

(57) ABSTRACT

A system for stowing a swimming pool cleaner robot in a location has a deployment piston connected to the robot and suitable for moving in a pipe of the swimming pool. The system also has a device to generate extra pressure in the pipe during a cleaning stage during which the swimming pool is cleaned by the robot in such a manner as to drive the deployment piston to a first position in the pipe; and a device to generate suction in the pipe during a filtering stage during which the water of the swimming pool is filtered, while the robot is inactive in such a manner as to suck the deployment piston to a second position in the pipe, making it possible for the robot to be stowed in the location.

17 Claims, 11 Drawing Sheets

SYSTEM FOR STOWING A ROBOT IN A SWIMMING POOL

BACKGROUND OF THE INVENTION

The invention relates to a system for automatically stowing a swimming pool cleaner robot in a location, it being possible for the location to be a niche provided in the wall of the swimming pool, or a location in the pool itself.

Document U.S. Pat. No. 6,922,855 describes a system for stowing a suction robot in a niche provided in the wall of a swimming pool, or for taking the robot out of the niche so that it cleans the swimming pool. In that system, the suction robot is connected to a piston suitable for moving in a conduit under the effect of a water pump connected to said conduit. More precisely, that water pump is suitable for generating extra pressure in the conduit so as to push the piston, thereby deploying the robot from its niche, and for generating suction for sucking in the piston, thereby retracting the robot into its niche. During cleaning, while the robot is out of its niche, the water pump generates suction in the conduit, and the water sucked up by the robot passes through the piston and back up the above-mentioned conduit towards the pump for filtering purposes.

That system suffers from two major drawbacks.

Firstly, it is necessary to provide blocking means for blocking the piston during the cleaning stage. Otherwise the piston would also be sucked in, thereby, as explained above, causing the robot to be stowed into its niche. Such blocking means are complex to control.

Secondly, it is frequent for the water sucked up by the robot to contain dirt that is deposited in the conduit and thus hinders the movement of the piston in the conduit. Document U.S. Pat. No. 6,922,855 proposes various piston configurations for overcoming that problem, but does not prevent dirt from being deposited in the conduit.

OBJECT AND SUMMARY OF THE INVENTION

An object of the invention is to provide a stowage system that does not suffer from the above-mentioned drawbacks.

The invention provides a system for stowing a swimming pool cleaner robot in a location, which system comprises:

- a deployment piston connected to said robot and suitable for moving in a pipe of said swimming pool;
- means for acting, during a cleaning stage during which the swimming pool is cleaned by said robot, to generate extra pressure in said pipe, in such a manner as to drive the deployment piston to a first position in said pipe; and
- means for acting, during a filtering stage during which the water of said swimming pool is filtered, while said robot is inactive, to generate suction in said pipe, in such a manner as to suck said deployment piston to a second position in said pipe, making it possible for said robot to be stowed in said location.

In this way, and very advantageously, the deployment piston is not sucked in during the cleaning stage, and it is not necessary to provide means for blocking said piston. In the invention, the stroke of the piston in each of the directions can be limited merely by respective abutments.

The system of the invention is thus particularly simple to control because it suffices to switch over from the filtering stage to the cleaning stage in order to stow or to deploy the robot relative to its location.

In a particular embodiment, the invention may be implemented by using the water pump of the swimming pool and a single 3-port valve to generate suction or extra pressure in the above-mentioned pipe. This valve may be controlled merely by a timer.

It should also be noted that, during the filtering stage, when the robot is inactive, the suction maintained in the pipe makes it possible to keep the robot in it is location. In other words, even if a person, e.g. a child, were to try and pull the robot out of its location for fun, that person would encounter some resistance, and the robot would automatically be stowed as soon as the person ceases to pull on the robot.

This is not so in the system described in above-mentioned Document U.S. Pat. No. 6,922,855.

In a particular embodiment, the system of the invention further comprises, in a pipe of the filter circuit of the swimming pool, a stowage piston connected to the deployment piston, and means for generating suction in this pipe during the filtering stage.

In this embodiment, as soon as the system switches over to the filtering stage, the deployment piston is driven by the stowage piston for stowing the robot. This makes it possible advantageously to facilitate the movement of the deployment piston towards the above-mentioned second position.

This stowage piston is optional.

In another embodiment, the system of the invention further comprises means for closing the filter circuit of said swimming pool, the deployment piston being provided with means for opening the filter circuit when the deployment piston is in the above-mentioned second position.

These closure means may be constituted merely by a stop valve having a valve stem, e.g. made of stainless steel, said deployment position being designed to push the stem and to open the valve when said piston takes up its second position.

By means of this mechanism, the filter circuit thus remains closed throughout the return movement of the deployment piston to the second position, thereby preventing or reducing head loss in the pipe of the deployment piston.

This is not so in the system described in above-mentioned Document U.S. Pat. No. 6,922,855 because in that system, water flows permanently through the piston, thereby making it necessary to use a powerful pump for stowing the robot.

In a particular embodiment, the system of the invention further comprises means for preventing water from flowing back up into the filter circuit during the cleaning stage.

These means may be constituted merely by a stop valve positioned to open automatically under the pressure from the water flowing through said filter circuit during the filtering stage.

The invention may be used for all types of cleaner robot.

This is not so with the system described in Document U.S. Pat. No. 6,922,855 that operates with suction robots only.

In a particular embodiment, when the robot is a suction robot connected to the deployment piston via a hose, the deployment piston is provided with a passage for passing the water sucked up by the suction robot, which passage is placed facing a pipe of a cleaning circuit of the swimming pool when said deployment piston is in the above-mentioned first position.

The person skilled in the art can understand that, in the invention, the water sucked up by the robot does not flow through the pipe in which the piston moves. Therefore, only clean water flows through this pipe.

However, it can happen that dirt might be deposited in the pipe of the deployment piston, at said piston, during the cleaning stage. In order to avoid this problem, the deployment piston can be provided with gaskets that fit the above-mentioned pipe and that prevent any such dirt from blocking the piston. The person skilled in the art can understand that such dirt is, in any event, sucked out during the next cleaning stage.

The invention thus makes it possible to prevent this pipe from clogging up.

BRIEF DESCRIPTION OF THE DRAWINGS

Other characteristics and advantages of the present invention appear from the following description given with reference to the accompanying drawings which show an example of the present invention that is in no way limiting. In the figures.

DETAILED DESCRIPTION OF EMBODIMENTS

Embodiments of the invention for stowing a cleaner robot 100A, 100B, 100C in a location 7 of a swimming pool 1 are described below.

The location 7 may be constituted merely by a setback. It may also be protected by a flap.

In the invention, the cleaner robot 100A, 100B, 100C is connected to a deployment piston 110A, 110B, 110C, the structure of the deployment piston and the connection between the deployment piston and the robot depending on the type of the robot (suction, pressure, or electric).

In general, the "filtering" stage during which the cleaner robot 100A, 100B, 100C is inactive and placed in its location 7, is always distinguished from the "cleaning" stage during which the robot 100A, 100B, 100C is operational and moving inside the swimming pool 1.

In this document:

- the term "cleaning pipe" is used to mean any pipe through which water flows during the cleaning stage; and
- the term "filtering pipe" is used to mean any pipe through which water flows during the filtering stage.

In this definition, a pipe may be termed both a "cleaning pipe" and a "filtering pipe" if it is used during both of these stages.

Figure 1:
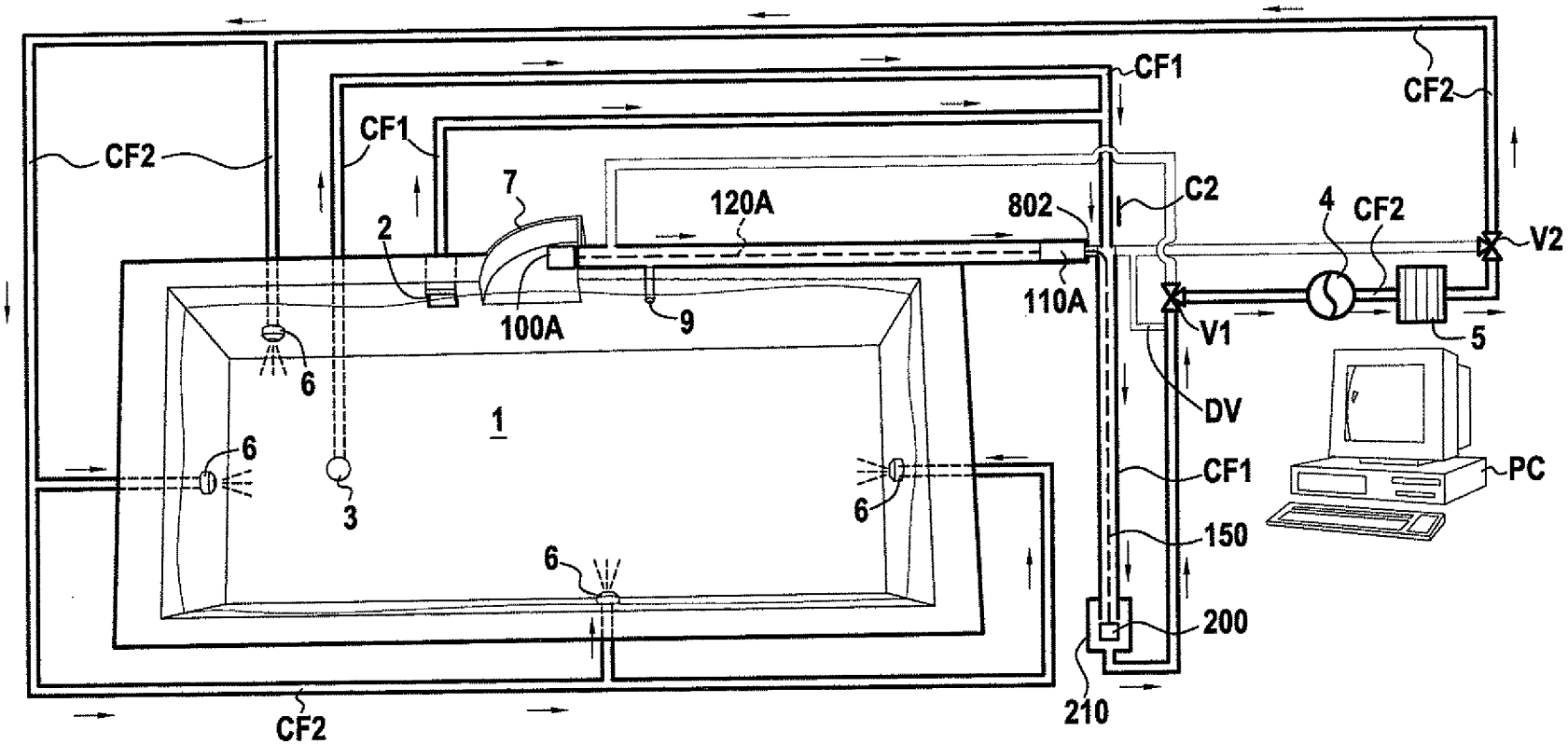
FIGS. 1 to 3 show a first implementation of the invention for a suction robot.

FIG. 1 shows a first embodiment of a system of the invention, in which system the cleaner robot is a suction robot 100A, during a filtering stage.

During this stage, the water circulates through the system in a filter circuit that has as its main component parts:

- skimmers 2 fitted in the upper portion of the swimming pool 1;
- a bottom plug 3 fitted in the deepest place in the swimming pool 1 and serving essentially to suck water from the bottom of the pool, in a manner complementary to the skimmers 2;
- a water pump 4; this pump makes it possible to suck water from the pool via the skimmers 2 and via the bottom plug 3;
- upstream filtering pipes CF1 connecting the skimmers 2 and the bottom plug 3 to the water pump 4;
- a filter 5 placed downstream from the water pump 4 for filtering the water sucked up via the skimmers 2 and via the bottom plug 3;
- delivery outflows 6 fitted in the pool for reinjecting the water back into the pool after filtering by the filter 5; and
- downstream filtering pipes CF2 connecting the water pump 4 to the delivery outflows 6, the filter 5 being placed on one of these pipes, generally just downstream from the water pump 4.

In known manner, during the filtering stage, the water pump 4 sucks water from the swimming pool 1 via the skimmers 2 and via the bottom plug 3, the water being conveyed to the water pump 4 via upstream filtering pipes CF1, and then delivered back into the pool 1 via the downstream filtering pipes CF2 and via the delivery outflows 6, after being filtered by the filter 5.

Figure 2:
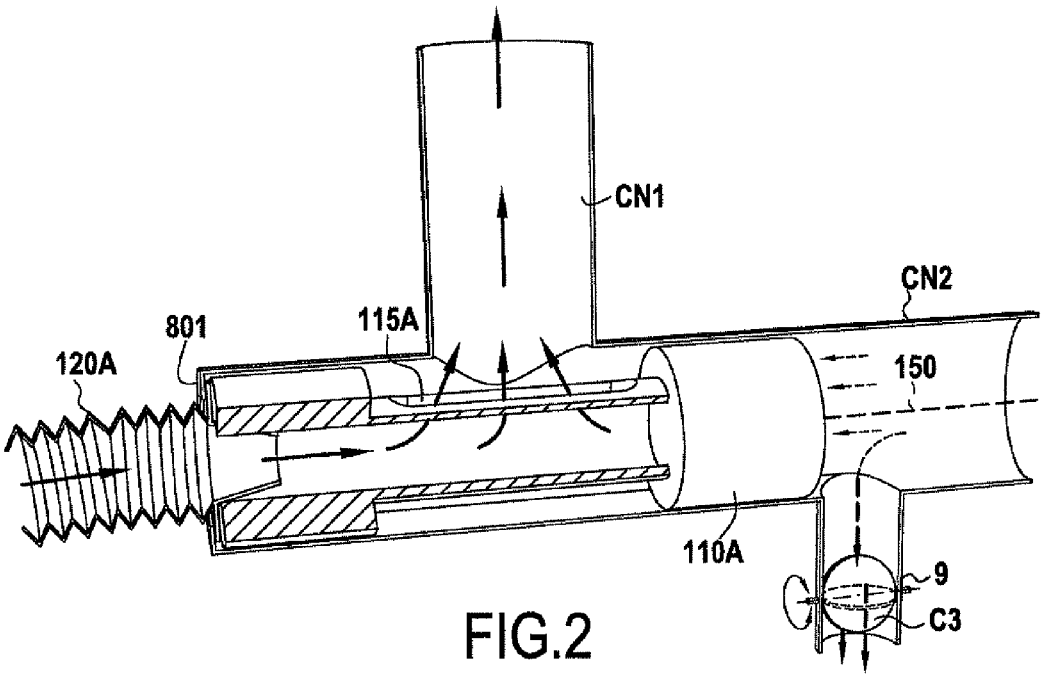

In this embodiment, the suction robot 100A is connected to its deployment piston 110A via a hose 120A shown in FIG. 2.

The deployment piston 110A is provided with a passage 115A for the water sucked up by the vacuum-cleaner robot 100A.

Figure 3:
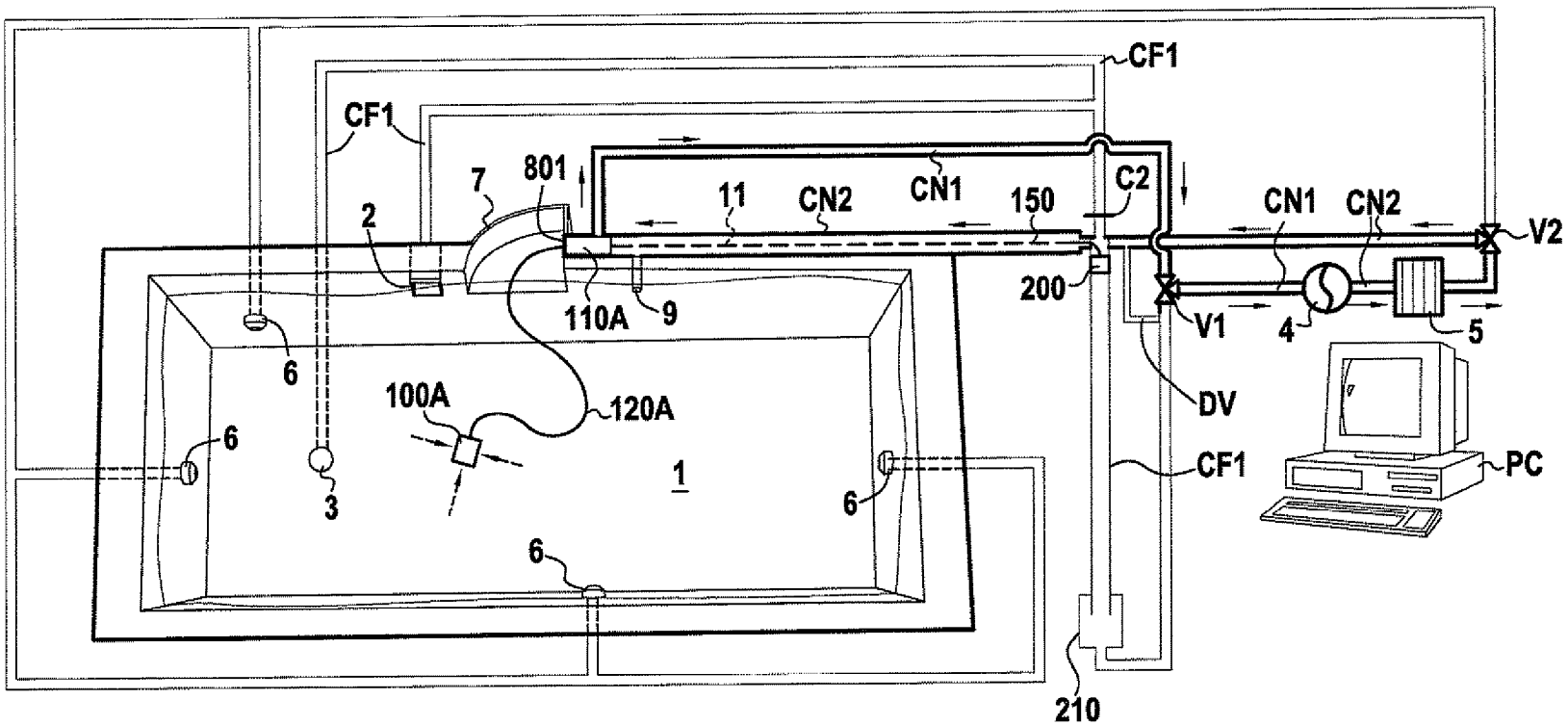

FIG. 3 shows the system of FIG. 1 during a cleaning stage.

During this stage, the water circulates through the system in a cleaning circuit including in particular:

- upstream cleaning pipes CN1 making it possible to convey the water sucked up by the suction robot 100A to the water pump 4; and
- downstream cleaning pipes CN2 making it possible to deliver the water back into the pool 1 after it has been filtered by the filter 5.

During the cleaning stage, the water from the swimming pool 1 is sucked up by the cleaner robot 100A under the effect of the water pump 4. The deployment piston 110A is positioned so that the passage 115A finds itself facing the inlet of the upstream cleaning pipe CN1.

The water sucked up during the cleaning stage by the robot 100A is filtered by the filter 5 and is then reinjected into the pool 1 via a discharge 9 provided in the downstream cleaning pipe CN2.

In this embodiment, a stop valve C2 is positioned substantially at the junction between the upstream filtering pipe CF1 and the downstream cleaning pipe CN2.

It makes it possible to prevent the filtered water from flowing back into the upstream filtering pipe CF1 during the cleaning stage.

This stop valve C2 is positioned to open automatically under the pressure from the water flowing through the upstream filtering pipe CF1 during the filtering stage and to close again during the cleaning stage when the water is directed into the downstream cleaning pipe CN2.

In this embodiment, the system has two 3-port valves V1, V2 respectively upstream from and downstream from the water pump 4 and a controller PC suitable for controlling these valves, so as to switch between the filtering stage and the cleaning stage.

The upstream valve V1 can take up:

- a "cleaning" position making it possible for the water pump 4 to generate suction in the upstream cleaning pipe CN1; or
- a "filtering" position making it possible for the water pump 4 to generate suction in the upstream filtering pipe CF1 and in the downstream cleaning pipe CN2, amplified, in this example, by a pipe DV.

The downstream valve V2 can take up:

- a "cleaning" position making it possible to generate extra pressure in the downstream cleaning pipe CN2 where the deployment piston 110A is situated, and to deliver the water filtered by the filter 4 into this pipe; or a "filtering" position making it possible to deliver the flow filtered by the filter 4 into the downstream filtering pipe CF2.

In order to quit the filtering stage and switch over to the cleaning stage, it suffices to position the upstream valve V1 and the downstream valve V2 in the "cleaning positions", it being possible for this to be achieved by a controller PC (computer, timing system, control panel, etc.).

Due to the position of the downstream valve V2, the water filtered by the filter 5 is thus reinjected into the pool 1 via the downstream cleaning pipe CN2, driving the piston 110A to a position defined by an abutment 801 at the end of this pipe, thereby making it possible to deploy the robot 100A from its location 7.

In this position, the passage 115A in the piston 110A coincides with the inlet of the upstream cleaning pipe CN1, the water being sucked up by the water pump 4 due to the position of the upstream valve V1.

In order to quit the cleaning stage and switch over to the filtering stage, it suffices for the controller PC to position the upstream valve V1 and the downstream valve V2 in the "filtering positions".

In this embodiment, the system includes a stowage piston 200 that is connected to the deployment piston 110A via a link 150, e.g. a chain.

The stowage piston 200 is placed in the upstream filtering pipe CF1, downstream from the stop valve C2.

When the upstream 3-port valve V1 is positioned in the "filtering position", the water pump 4 sucks up the water contained in the upstream filtering pipe CF1 and the water contained in the downstream cleaning pipe CN2, thereby making it possible to drive both the deployment piston 110A situated in the downstream cleaning pipe CN2 and also the stowage piston 200 situated in the upstream filtering pipe CF1.

The stroke of the deployment piston 110A stops at a second position defined by an abutment 802. The cleaner robot 100A is thus pulled to its location 7.

In this embodiment, the upstream filter circuit CF1 has a chamber 210 for making it easier for water to pass around the stowage piston 200 during the filtering stage.

It is preferable, in order to enable the stowage piston 200 to move on going over to the cleaning stage, to avoid a suction cup effect in the upstream filtering pipe CF1. In this example, this function is performed by the pipe DV.

Figure 4:
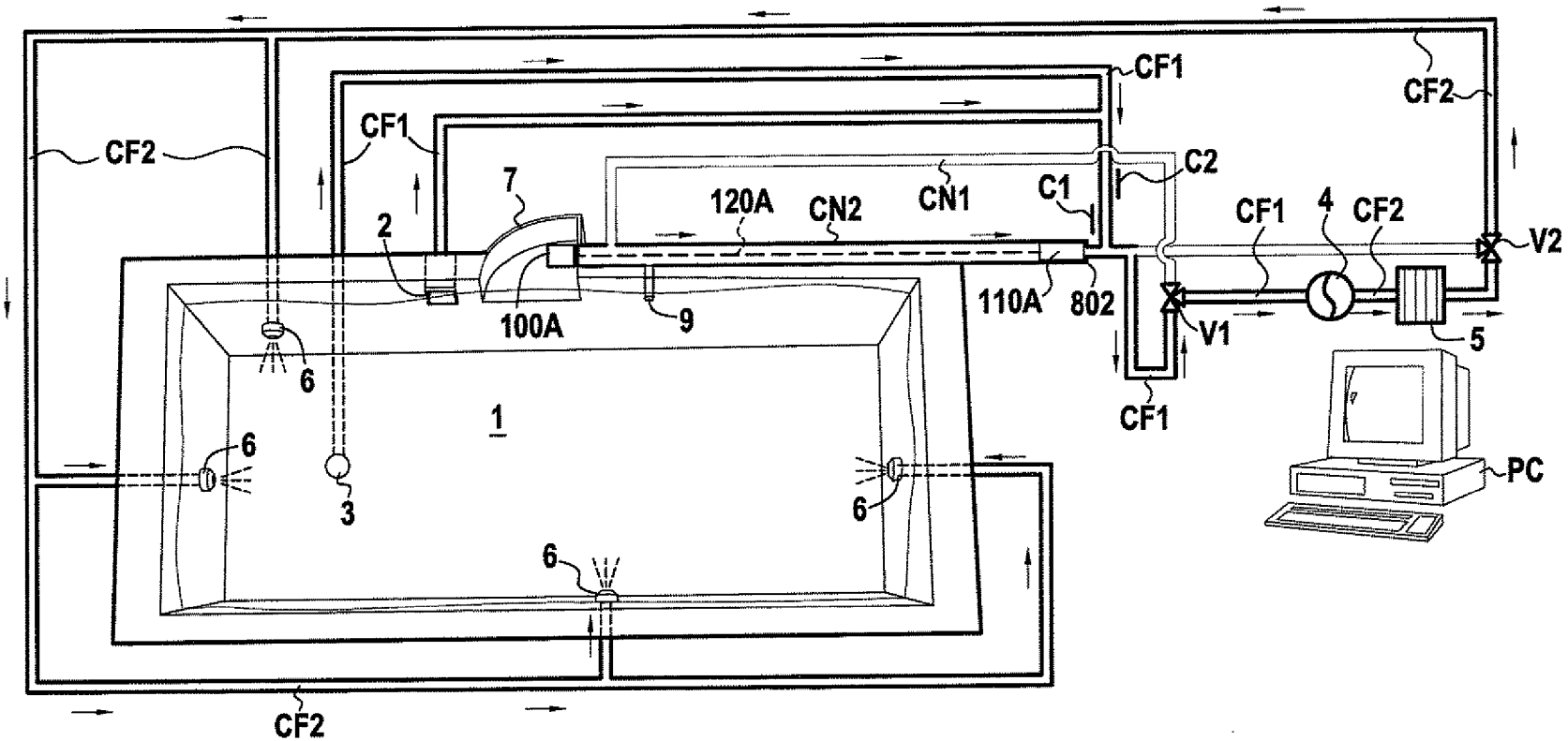
FIGS. 4 to 6 show a second implementation of the invention for a suction robot.
Figure 5:
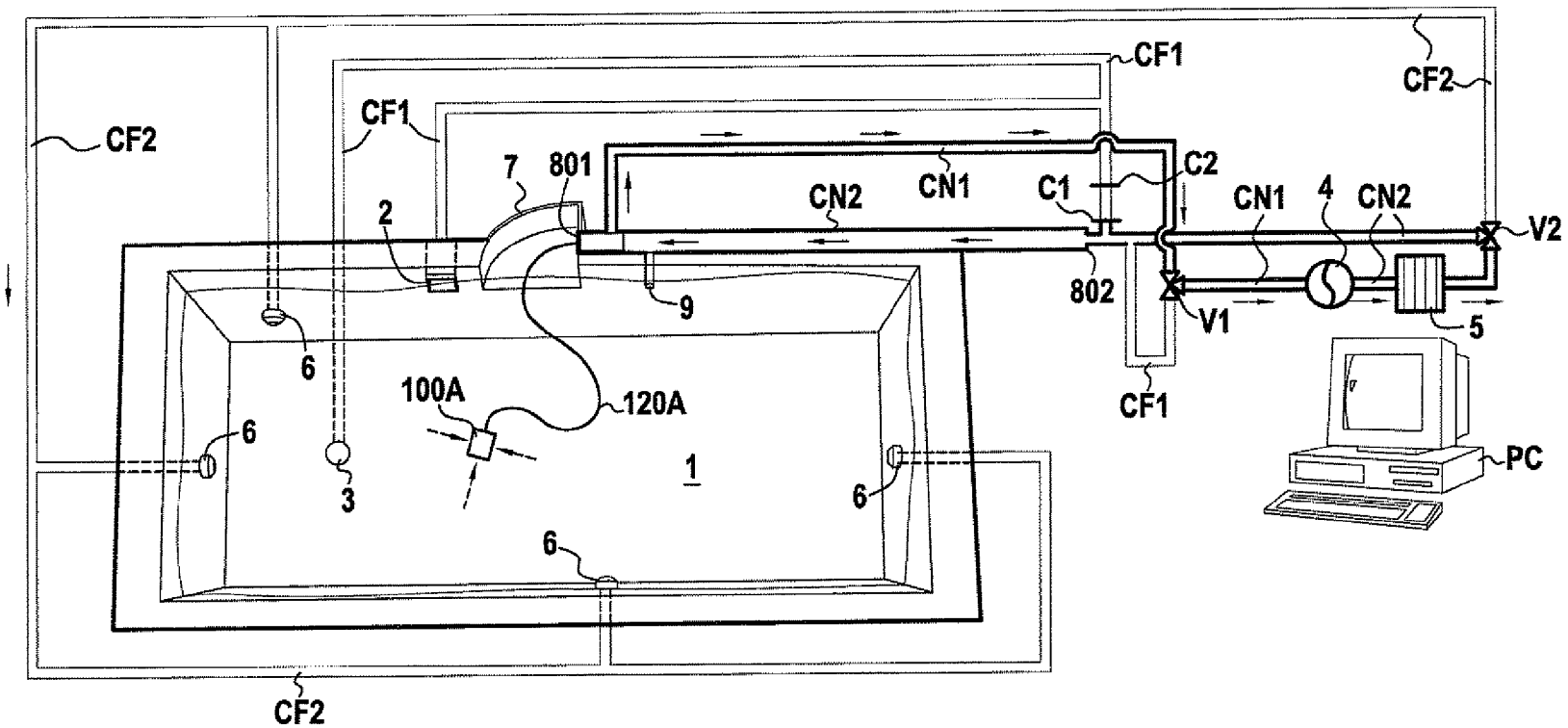

FIGS. 4 and 5 show a second embodiment of a system of the invention, in which the cleaner robot is a suction robot 100A, respectively during the filtering stage and during the cleaning stage.

This second embodiment is distinguished from the first embodiment in that it does not use a stowage piston 200 to bring the suction robot 100A back into its location 7, but rather it uses a stop valve mechanism C1.

It should be noted that, in this embodiment, the upstream filtering pipe CF1 can be simplified due to the absence of the stowage piston 200 and of the link 150.

In this embodiment, a stop valve C1 closes the filter circuit of the swimming pool, in order to avoid head loss in the pipe CN2 while the deployment piston 110A is moving back during the transition between the cleaning stage and the filtering stage.

In this embodiment, the valve C1 is positioned substantially at the junction between the upstream filtering pipe CF1 and the downstream cleaning pipe CN2.

Figure 6:
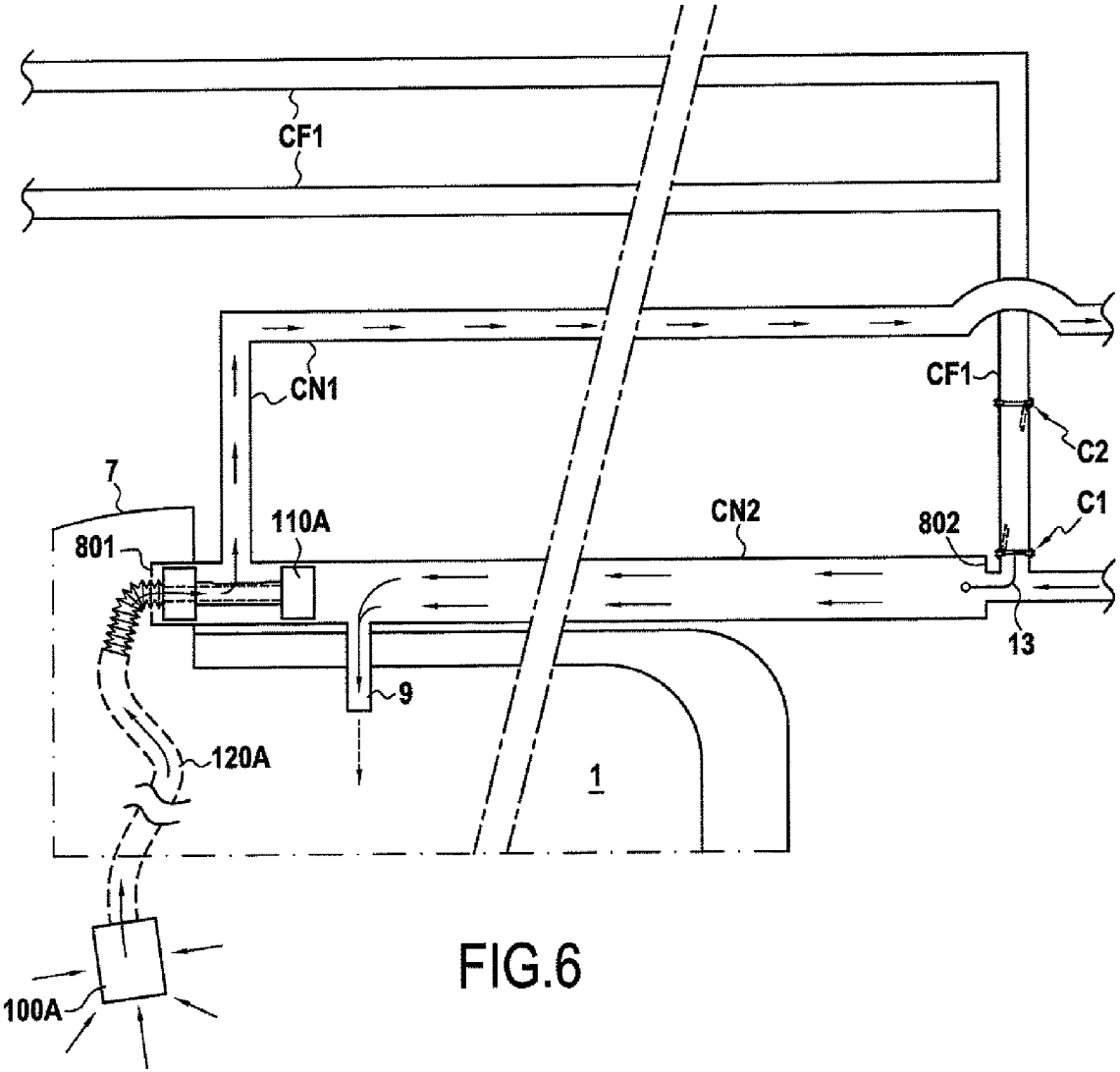
Figure 7:
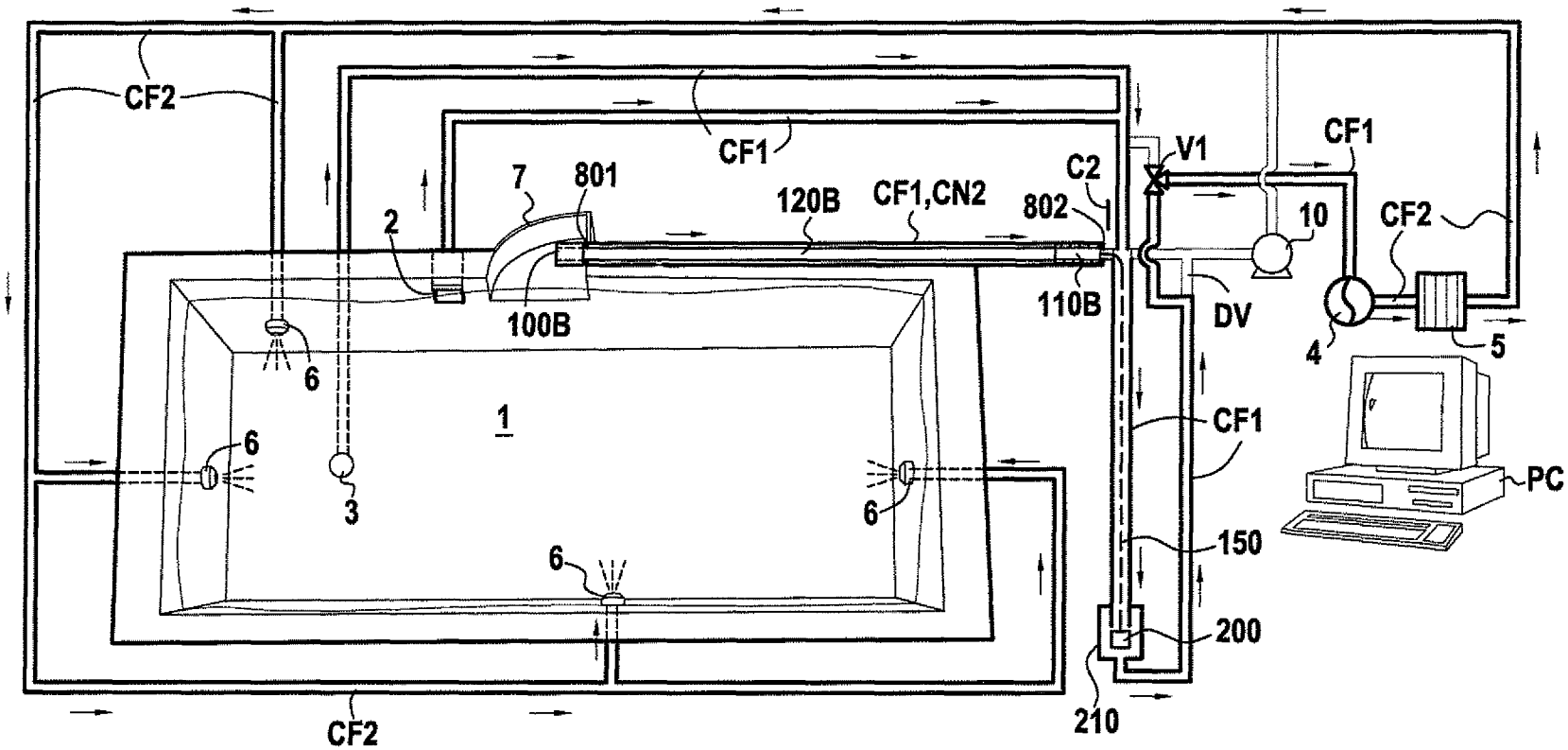

In this embodiment, the deployment piston 110A has means for opening the filter circuit. In this embodiment, the valve C1 is secured to a stem 13 that the deployment piston 110A comes to push while it is being sucked in by the water pump 4 just before it reaches the abutment 802. This arrangement is shown in FIG. 6.

This valve C1 is held open by the deployment piston 110A during the filtering stage.

With reference to FIGS. 7 to 11, implementation of the invention, in two embodiments, is described below when the cleaner robot is a pressure robot 100B.

Figure 8:
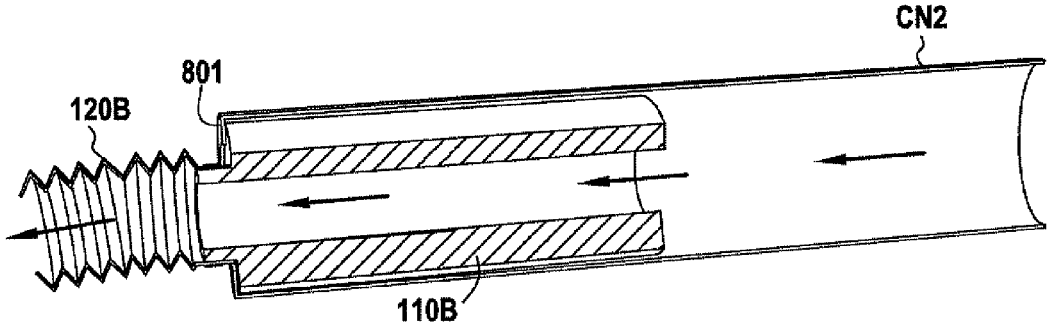
FIGS. 7 to 9 show a first implementation of the invention for a pressure robot.

The pressure robot 100B is connected to its deployment piston 110B via a hose 120B shown in FIG. 8. In this embodiment, the deployment piston 110B is open at both ends so that pressurized water can feed the robot.

In the first embodiment (FIGS. 7 and 9), the system has a stowage piston 200 in an upstream pipe CF1 of the filter circuit and a link 150 for pulling the deployment piston 110B during the transition between the cleaning stage and the filtering stage and throughout the filtering stage.

The filtering stage takes place exactly as described above with reference to FIG. 1.

Figure 9:
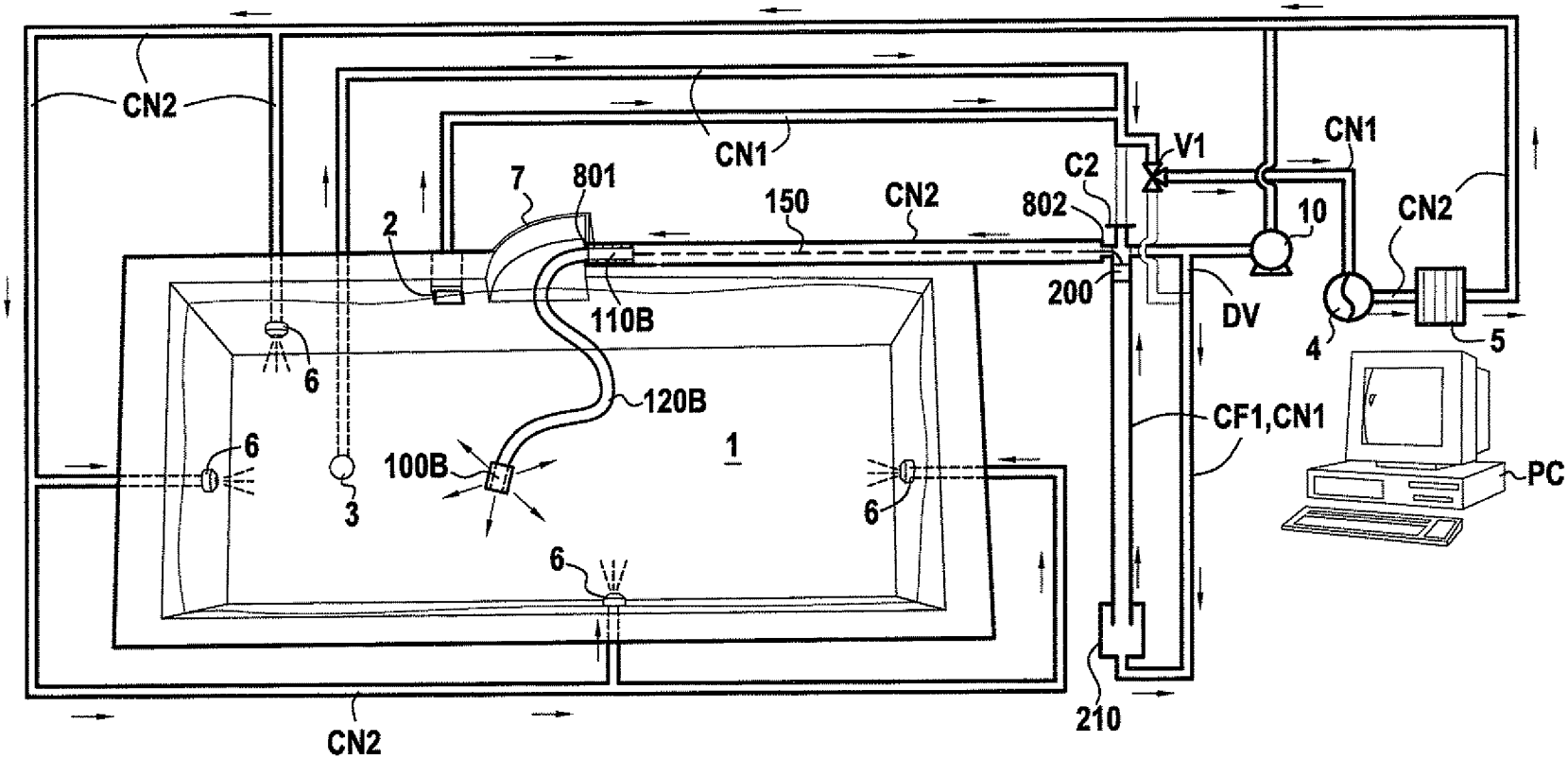
Figure 10:
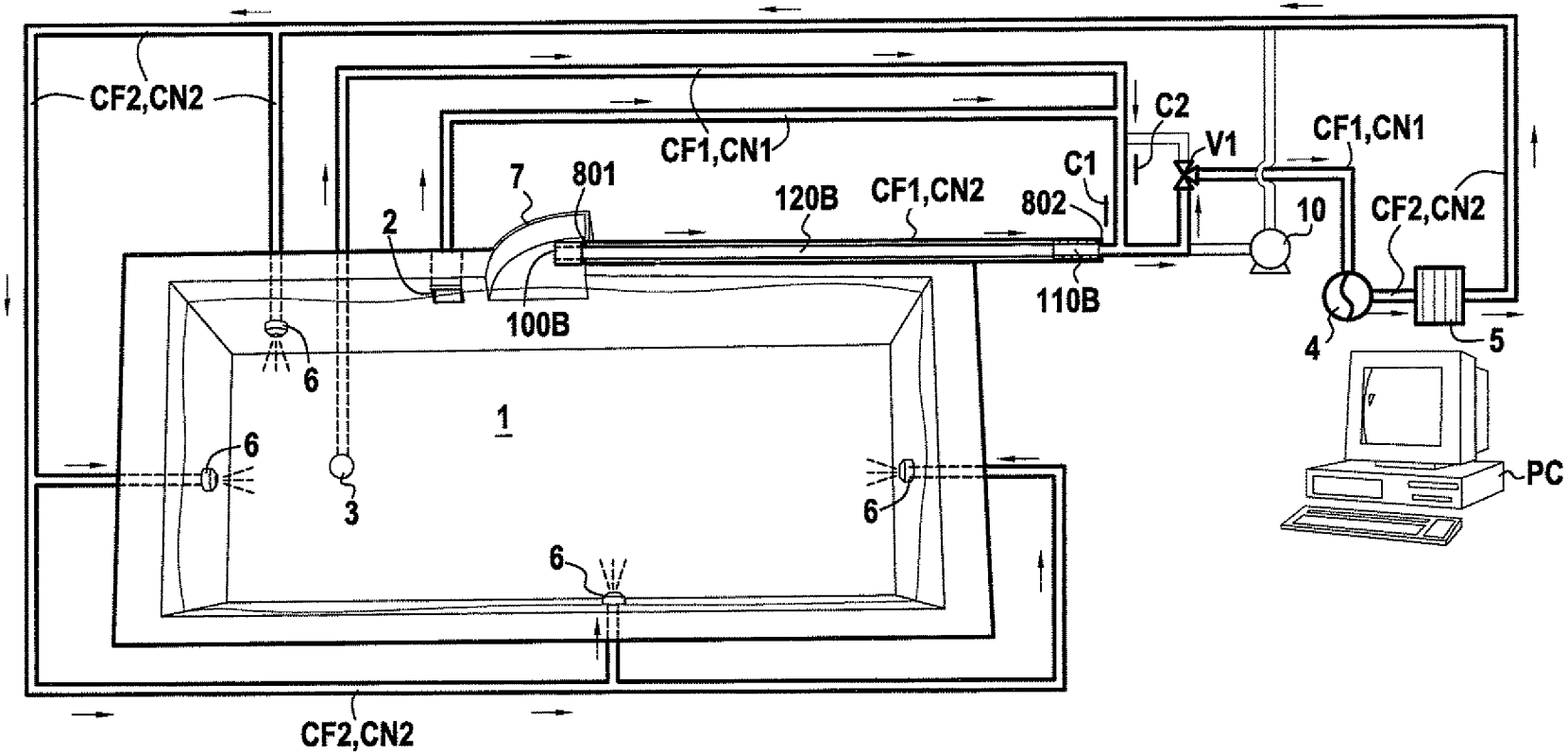
FIGS. 10 and 11 show a second implementation of the invention for a pressure robot.
Figure 11:
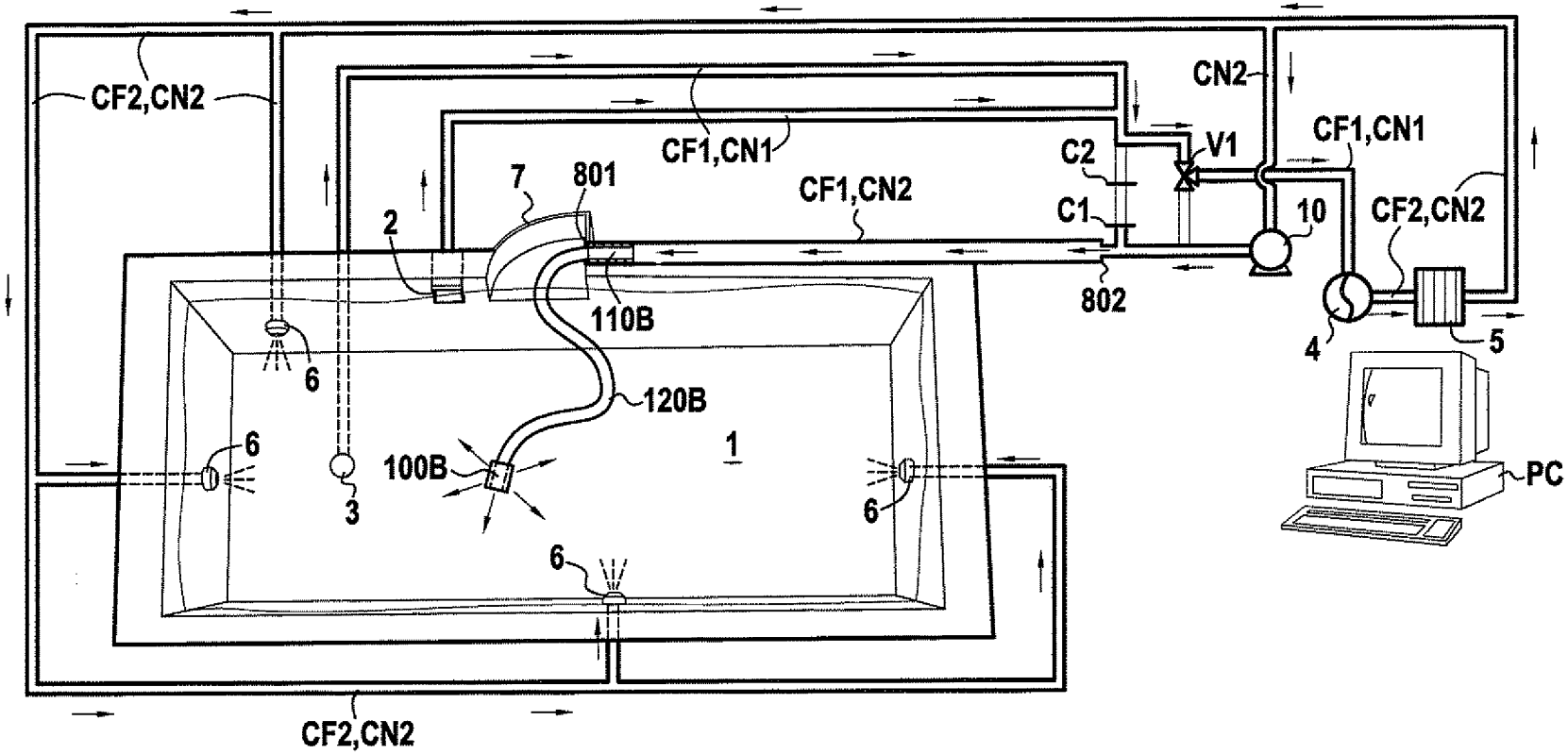

Conversely, the cleaning circuit is different. It is shown in FIG. 9.

In this embodiment, the water from the swimming pool 1 is sucked up, as during the filtering stage, via the skimmers 2 and via the bottom plug 3 under the effect of the water pump 4.

In other words, the pipes CN1 upstream from the water pump 4 that are used during the cleaning stage are the upstream pipes CF1 that are used during the filtering stage.

The water that is sucked up is filtered by the filter 5 and is then reinjected into the pool 1 via the downstream cleaning pipes CN2 constituted firstly by the downstream filtering pipes CF2 opening out at the delivery outflows 6, and secondly via the downstream cleaning pipe CN2 in which the deployment piston 110B moves.

In this embodiment, the pressure of the water sent to the pressure robot 100B is raised by a booster pump 10.

In this embodiment, the system includes a single 3-port valve V1 upstream from the water pump 4 and a controller PC suitable for controlling this valve, so as to switch between the filtering stage and the cleaning stage, while the booster pump 10 is being switched on.

The upstream valve V1 can take up:

a "cleaning" position making it possible for the water pump 4 and for the booster pump 10 to generate extra pressure in the downstream cleaning pipe CN2 where the deployment piston 110B is situated, and to generate suction in the upstream cleaning pipe CN1; or a "filtering" position making it possible for the water pump 4 to generate suction in the upstream filtering pipe CF1 and in the downstream cleaning pipe CN2.

In order to go over from the filtering stage to the cleaning stage, the controller PC positions the upstream valve V1 in the "cleaning position" and switches on the booster pump 10.

The deployment piston 110B is then driven to the abutment 801.

Advantageously, the pipe DV makes it possible to inject a fraction of the water delivered by the booster pump 10 into this pipe CF1, so as to drive the stowage piston 200 in order to make it easier for the deployment piston 110B to move to the abutment 801.

In order to go over to the filtering stage, it suffices to position the upstream valve V1 in the "filtering position" so that the water pump 4 sucks up the water contained in the upstream filtering pipe CF1, thereby driving the stowage piston 200.

The stroke of the deployment piston 110B stops when it meets the abutment 802 provided for this purpose. The cleaner robot 100B is thus pulled to its location 7.

In the second embodiment (FIGS. 10 and 11), the stowage piston 200 and the link 150 are replaced with a stop valve C1.

Similarly to when the robot is a suction robot 100A, the valve C1 closes the filter circuit of the swimming pool in order to avoid head loss in the pipe CN2 while the deployment piston 110B is moving back during the transition between the cleaning stage and the filtering stage.

This valve C1 is held open by the deployment piston 110B during the filtering stage.

Figure 12:
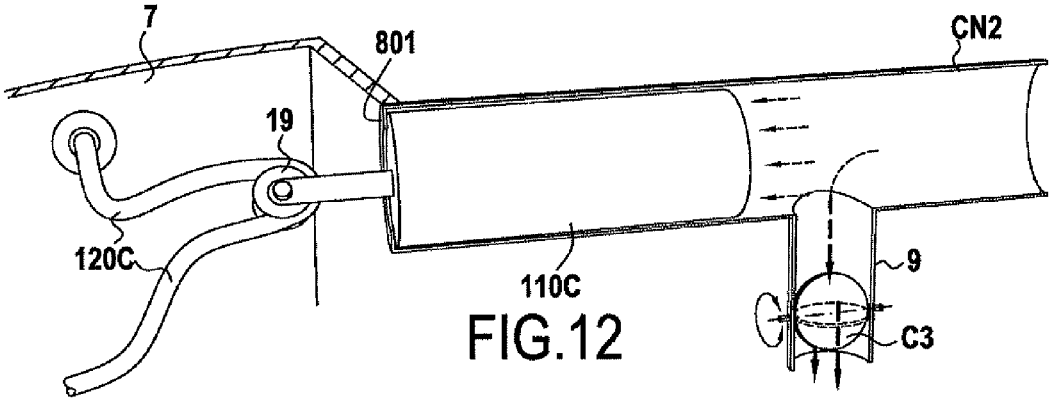
FIGS. 12 and 13 show an implementation of the invention for an electric robot.
Figure 13:
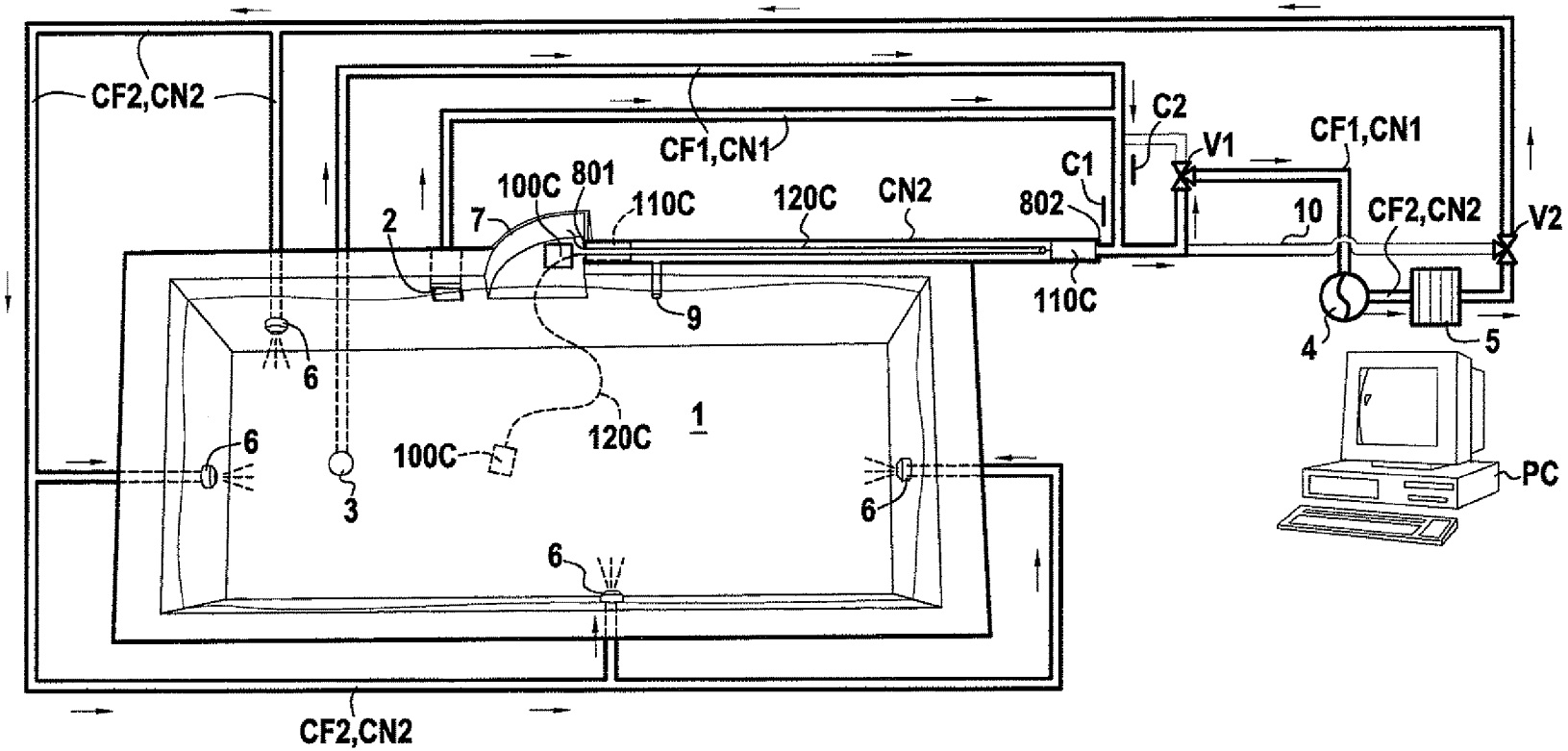

FIGS. 12 and 13 show an embodiment of the invention when the cleaner robot is an electric robot 100C.

In this embodiment, the electric robot 100C is powered via an electrical cord connected in the vicinity of the location 7.

FIG. 12 shows a deployment piston 110C that can be used in this embodiment, which piston has a pulley 19 for passing a power cord 120C.

FIG. 13 shows the filtering stage in an embodiment in which a stop valve C1 is used.

In this embodiment, the system includes an upstream 3-port valve V1 and a downstream 3-port valve V2 that are similar to the 3-port valves described with reference to FIGS. 3 and 4.

In the situation shown in FIG. 13, these valves are in the filtering positions.

Due to the position of the upstream valve V1, the water pump 4 generates suction in the upstream filtering pipe CF1 and in the downstream cleaning pipe CN2, sucking the deployment piston 110C to the abutment 802.

Naturally, the embodiment with a stowage piston 200 can also be used with an electric robot 100C.

In this particular embodiment, the discharge 9 is provided with a stop valve C3 when a suction robot 100A or an electric robot 100C is used, in order to avoid head loss in the pipe in which the deployment piston 100A, 100C moves.

What is claimed is:

1. A system for stowing a swimming pool cleaner robot in a location in a swimming pool, the system comprising:

a deployment piston connected to said robot, the deployment piston being configured to be movable from at least a first position to a second position in a first pipe communicating with said swimming pool;

a stowage piston positioned in a second pipe of a filter circuit, the stowage piston being connected to said deployment piston; and at least one pump configured to operate as a pressure device during a cleaning stage during which the swimming pool is cleaned by said robot, the at least one pump being configured to generate pressure in said first pipe during the cleaning stage in such a manner as to drive the deployment piston to the first position in said first pipe and to maintain the deployment piston at the first position so that the deployment piston is not sucked into said first pipe during the cleaning stage;

said at least one pump also being configured to operate as a suction device during a filtering stage during which water of said swimming pool is filtered, while said robot is inactive, to generate suction in said first pipe in such a manner as to suck said deployment piston to a second position in said first pipe, thereby enabling stowage of said robot in said second position, said suction tending to automatically bring said robot back to the second position if pulled out from said second position during the filtering stage.

2. The system according to claim 1, wherein said at least one pump is configured to generate a suction in said second pipe of the filter circuit during said filtering stage.

3. The system according to claim 1, further comprising a backflow preventing device configured to prevent water from flowing back up into the filter circuit during said cleaning stage.

4. The system according to claim 1, wherein said robot comprises a suction robot connected to said deployment piston via a hose, said deployment piston having a passage for passing the water sucked up by the suction robot, which passage is configured to face a pipe of a cleaning circuit of said swimming pool when said deployment piston is in said first position.

5. A system for stowing a swimming pool cleaner robot in a location in a swimming pool, the system comprising:

a deployment piston connected to said robot, the deployment piston being configured to be movable from at least a first position to a second position in a pipe communicating with said swimming pool;

at least one pump configured to operate as a pressure device during a cleaning stage during which the swimming pool is cleaned by said robot, the at least one pump being configured to generate pressure in said pipe during the cleaning stage in such a manner as to drive the deployment piston to the first position in said pipe and to maintain the deployment piston at the first position so that the deployment piston is not sucked into said pipe during the cleaning stage;

said at least one pump also being configured to operate as a suction device during a filtering stage during which water of said swimming pool is filtered, while said robot is inactive, to generate suction in said pipe in such a manner as to suck said deployment piston to a second position in said pipe, thereby enabling stowage of said robot in said second position, said suction tending to automatically bring said robot back to the second position if pulled out from said second position during the filtering stage; and a closing device for the filter circuit of said swimming pool, said deployment piston having an opening device configured to open said filter circuit when said deployment piston is in said second position.

6. The system according to claim 5, further comprising a backflow preventing device configured to prevent water from flowing back up into the filter circuit during said cleaning stage.

7. The system according to claim 5, wherein said robot comprises a suction robot connected to said deployment piston via a hose, said deployment piston having a passage for passing the water sucked up by the suction robot, which passage is configured to face a pipe of a cleaning circuit of said swimming pool when said deployment piston is in said first position.

8. A system for stowing a swimming pool cleaner suction robot in a location in a swimming pool, the system comprising:

a deployment piston connected to said suction robot, the deployment piston being configured to be movable from at least a first position to a second position in a pipe communicating with said swimming pool; and at least one pump configured to operate as a pressure device during a cleaning stage during which the swimming pool is cleaned by said suction robot, the at least one pump being configured to generate pressure in said pipe during the cleaning stage in such a manner as to drive the deployment piston to the first position in said pipe and to maintain the deployment piston at the first position so that the deployment piston is not sucked into said pipe during the cleaning stage;

said at least one pump also being configured to operate as a suction device during a filtering stage during which water of said swimming pool is filtered, while said suction robot is inactive, to generate suction in said pipe in such a manner as to suck said deployment piston to a second position in said pipe, thereby enabling stowage of said suction robot in said second position, said suction tending to automatically bring said suction robot back to the second position if pulled out from said second position during the filtering stage.

9. The system according to claim 8, further comprising, in a pipe of a filter circuit of said swimming pool, a stowage piston connected to said deployment piston, wherein said at least one pump is configured to generate a suction in said pipe of the filter circuit during said filtering stage.

10. The system according to claim 8, further comprising a closing device for the filter circuit of said swimming pool, said deployment piston having an opening device configured to open said filter circuit when said deployment piston is in said second position.

11. The system according to claim 8, further comprising a backflow preventing device configured to prevent water from flowing back up into the filter circuit during said cleaning stage.

12. The system according to claim 8, wherein said suction robot is connected to said deployment piston via a hose, said deployment piston having a passage for passing the water sucked up by the suction robot, which passage is configured to face a pipe of a cleaning circuit of said swimming pool when said deployment piston is in said first position.

13. A system for stowing a swimming pool cleaner robot in a location in a swimming pool, the system comprising:

a deployment piston connected to said robot, the deployment piston being configured to be movable from at least a first position to a second position in a pipe communicating with said swimming pool;

at least one pump configured to operate as a pressure device during a cleaning stage during which the swimming pool is cleaned by said robot, the at least one pump being configured to generate pressure in said pipe during the cleaning stage in such a manner as to drive the deployment piston to the first position in said pipe and to maintain, by the pressure alone, the deployment piston at the first position so that the deployment piston is not sucked into said pipe during the cleaning stage: and said at least one pump also being configured to operate as a suction device during a filtering stage during which water of said swimming pool is filtered, while said robot is inactive, to generate suction in said pipe in such a manner as to suck said deployment piston to a second position in said pipe, thereby enabling stowage of said robot in said second position, said suction tending to automatically bring said robot back to the second position if pulled out from said second position during the filtering stage.

14. The system according to claim 13, further comprising, in a pipe of a filter circuit of said swimming pool, a stowage piston connected to said deployment piston, wherein said at least one pump is configured to generate a suction in said pipe of the filter circuit during said filtering stage.

15. The system according to claim 13, further comprising a closing device for the filter circuit of said swimming pool, said deployment piston having an opening device configured to open said filter circuit when said deployment piston is in said second position.

16. The system according to claim 13, further comprising a backflow preventing device configured to prevent water from flowing back up into the filter circuit during said cleaning stage.

17. The system according to claim 13, wherein said robot comprises a suction robot connected to said deployment piston via a hose, said deployment piston having a passage for passing the water sucked up by the suction robot, which passage is configured to face a pipe of a cleaning circuit of said swimming pool when said deployment piston is in said first position.

* * * * *